US011026514B2

(12) United States Patent
Serena

(10) Patent No.: US 11,026,514 B2
(45) Date of Patent: Jun. 8, 2021

(54) ADJUSTMENT DEVICE FOR A CHAIR WITH ROCKING MECHANISM

(71) Applicant: BRADO S.P.A., Frazione Bigolino (IT)

(72) Inventor: Stefano Serena, Caerano di San Marco (IT)

(73) Assignee: BRADO S.P.A., Frazione Bigolino (IT)

( * ) Notice: Subject to any disclaimer, the term of this patent is extended or adjusted under 35 U.S.C. 154(b) by 0 days.

(21) Appl. No.: 16/615,986

(22) PCT Filed: May 18, 2018

(86) PCT No.: PCT/EP2018/063053
§ 371 (c)(1),
(2) Date: Nov. 22, 2019

(87) PCT Pub. No.: WO2018/215330
PCT Pub. Date: Nov. 29, 2018

(65) Prior Publication Data

US 2020/0138196 A1 May 7, 2020

(30) Foreign Application Priority Data

May 26, 2017 (IT) ..... 102017000057341

(51) Int. Cl.
*A47C 3/02* (2006.01)
*A47C 3/026* (2006.01)
(Continued)

(52) U.S. Cl.
CPC ..... *A47C 7/443* (2013.01); *A47C 3/30* (2013.01)

(58) Field of Classification Search
CPC ..... A47C 3/30; A47C 7/443
(Continued)

(56) References Cited

U.S. PATENT DOCUMENTS 5,328,242 A * 7/1994 Steffens ..... A47C 1/027 297/374
5,397,111 A * 3/1995 Knopp ..... A47C 3/30 188/300

(Continued)

FOREIGN PATENT DOCUMENTS

EP 2554075 A1 2/2013

OTHER PUBLICATIONS

International Search Report and Written Opinion dated Jul. 5, 2018 issued in PCT/EP2018/063053.

(Continued)

*Primary Examiner* — Rodney B White
(74) *Attorney, Agent, or Firm* — Scully, Scott, Murphy & Presser, P.C.

(57) ABSTRACT

Adjustment device for a chair which is provided with a rocking mechanism composed of a first plate, fixed to a central gas-operated post for the height adjustment of a seat and to which a second plate is articulated, about a first axis that is transverse thereto and so that it can rock, the second plate being fixed to a seat or being integral with a seat and interacting with elements which are adapted to contrast the rocking of a backrest.
A first cable is slideably associated with the first plate and is adapted to activate a lever which is articulated internally to the first plate at a different second axis and is adapted to activate the height adjustment of the seat.
A second cable is further slideably associated with the first plate and is adapted to activate a mechanism which allows or prevents the rocking of the second plate.

10 Claims, 8 Drawing Sheets

(51) Int. Cl.
*A47C 3/03* (2006.01)
*A47C 7/44* (2006.01)
*A47C 3/30* (2006.01)

(58) Field of Classification Search
USPC ..... 297/285–301.7, 258.1, 259.4, 265.1
See application file for complete search history.

(56) References Cited

U.S. PATENT DOCUMENTS 5,577,804 A * 11/1996 Tedesco ..... A47C 3/30 297/344.19
5,671,972 A * 9/1997 Tedesco ..... A47C 1/0244 297/362.13
5,765,804 A * 6/1998 Stumpf ..... A47C 1/03266 248/631
5,899,530 A * 5/1999 Tedesco ..... A47C 7/443 297/328
5,915,788 A * 6/1999 Schneider ..... A47C 1/03255 297/301.3 X
6,120,096 A 9/2000 Miotto
9,010,859 B2 * 4/2015 Battey ..... A47C 7/441 297/296
9,173,491 B2 * 11/2015 Vander Veen ..... A47C 31/023
2005/0022661 A1 * 2/2005 Zanden ..... A47C 3/30 91/437
2011/0067931 A1 * 3/2011 Schmitz ..... A47C 31/126 177/144
2013/0033078 A1 * 2/2013 Bock ..... A47C 3/30 297/258.1
2014/0077558 A1 * 3/2014 Battey ..... A47C 1/03255 297/340
2016/0015179 A1 * 1/2016 Bonneywell ..... A47C 7/44 297/301.1 X
2018/0213939 A1 * 8/2018 Schmidt ..... A47C 7/443
2020/0345142 A1 * 11/2020 Battey ..... A47C 1/03266

OTHER PUBLICATIONS

Italian Search Report dated Jan. 3, 2018 issued in IT 102017000057341, with partial translation.

* cited by examiner

ADJUSTMENT DEVICE FOR A CHAIR WITH ROCKING MECHANISM

The present invention relates to an adjustment device for a chair that has a rocking mechanism.

Nowadays it is known to provide chairs that are fitted with a mechanism the function of which is to enable for example the height adjustment of a seat and the adjustment of the rocking, or the locking in place, of a backrest.

An example of the mentioned prior art is disclosed in U.S. Pat. No. 6,120,096, where the activation of the mechanisms which interact with the seat and with the backrest are activated by way of using a first lever, the rotation of which leads to the packing or otherwise of special slats, and also a second lever, the lifting of which leads to its terminal end interacting with a gas-filled piston present on a central gas-operated post.

Such rocking mechanisms are structurally complex and require a certain force of the user in order to activate the packing of the slats, which may also be subject to possible seizing.

EP 2554075B1 is also known, which relates to a chair with a rocking mechanism, wherein the rocking mechanism has a fixed base support with a conical receptacle, said fixed base support being placeable by means of the conical receptacle on a chair pillar of the chair, wherein the base support is connected pivotably to a mechanism upper part, which forms a housing at least partially enclosing the base support, wherein the pivot axis of the mechanism upper part, which pivot axis runs transversely with respect to the chair longitudinal direction, is arranged next to the conical receptacle, as seen in the chair longitudinal direction, wherein at least one spring element, interacting on the one hand with the mechanism upper part, and on the other hand with the base support is provided in order to return the mechanism upper part, from a pivoted position into a starting position, and wherein the rocking mechanism is fastened by means of the mechanism upper part to a seat, a seat support or a frame of the chair, or the rocking mechanism is integrated into the seat, the seat support or the frame of the chair, in such a manner that the mechanism upper part is formed by part of the seat, of the seat support or of the chair frame, characterized in that a valve pin for triggering a pneumatic spring placed in the interior of the chair pillar is located in the region of the conical receptacle, and, in order to trigger the pneumatic spring, a pivot lever interacting with at least part of the rocking mechanism is provided for actuating the valve pin, and in that the pivot lever is placed in such a manner that the axis of rotation of the pivot lever coincides with the pivot axis of the mechanism upper part.

This solution also has drawbacks: the fact that the rotation axis of the rocking lever is identical to the orientable axis of the upper part of the mechanism entails a compaction of the positioning of the components which compromises the achievement of an optimal rocking and of the optimal activation of the gas-filled post, given that the rocking lever, in order to actuate the pin of the valve of the pneumatic or gas-filled shock absorber, must interact with at least a part of the rocking mechanism.

In such solution, furthermore, there is a device for preventing the tilting function, to which movements can be imparted on both a vertical plane and on an oblique plane, making it rather unreliable owing to possible sticking or malfunction.

The aim of the present invention is to solve the above mentioned technical problems, eliminating the drawbacks in the cited known art, by providing a device that makes it possible to achieve at the same time, rapidly, simply and optimally, both the activation and prevention of rocking for a chair, and also the activation of the raising of said chair.

Within this aim, an object of the invention is to provide a device that, in addition to the foregoing characteristics, is also structurally simple and free from sticking.

Another object is to provide a device that is low cost and which can be made with the usual conventional systems.

This aim and these and other objects which will become better apparent hereinafter are achieved by an adjustment device for a chair which comprises a rocking mechanism composed of a first plate, which is fixed to a central gas-operated post for the height adjustment of a seat and to which a second plate is articulated, about a first axis that is transverse thereto and so that it can rock, said second plate being fixed to a seat or being integral with a seat and interacting with means which are adapted to contrast the rocking of a backrest, characterized in that a first cable is slideably associated with said first plate and is adapted to activate a lever which is articulated internally to said first plate at a second, different axis and is adapted to activate the height adjustment of said seat, a second cable being furthermore slideably associated with said first plate and being adapted to activate a mechanism which allows or prevents the rocking of said second plate.

Further characteristics and advantages of the invention will become better apparent from the detailed description of a particular but not exclusive embodiment thereof, illustrated by way of non-limiting example in the accompanying drawings, wherein.

Figure 1:
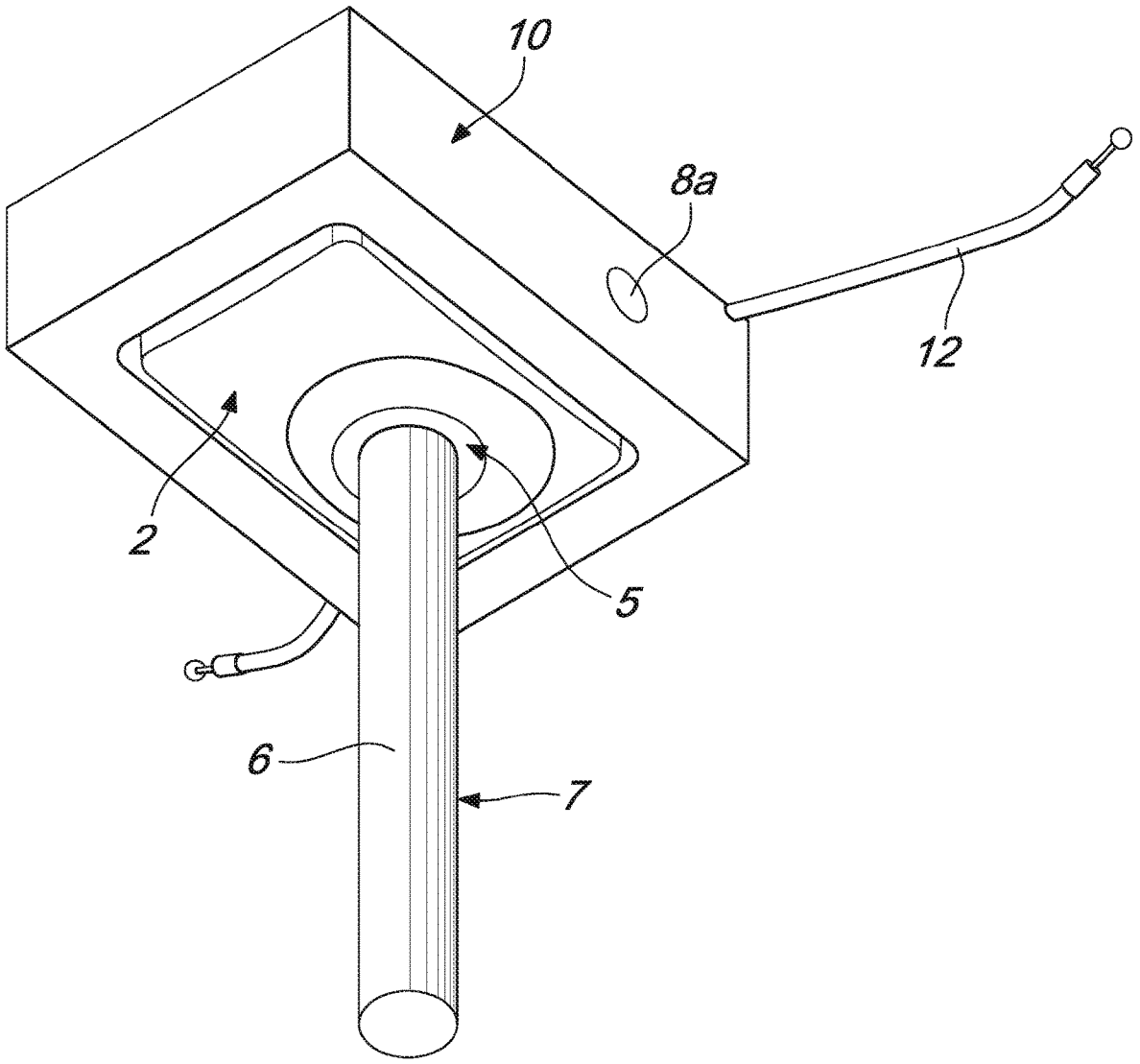
FIG. 1 is a perspective view from below of the device applied to a central gas-operated post.
Figure 2:
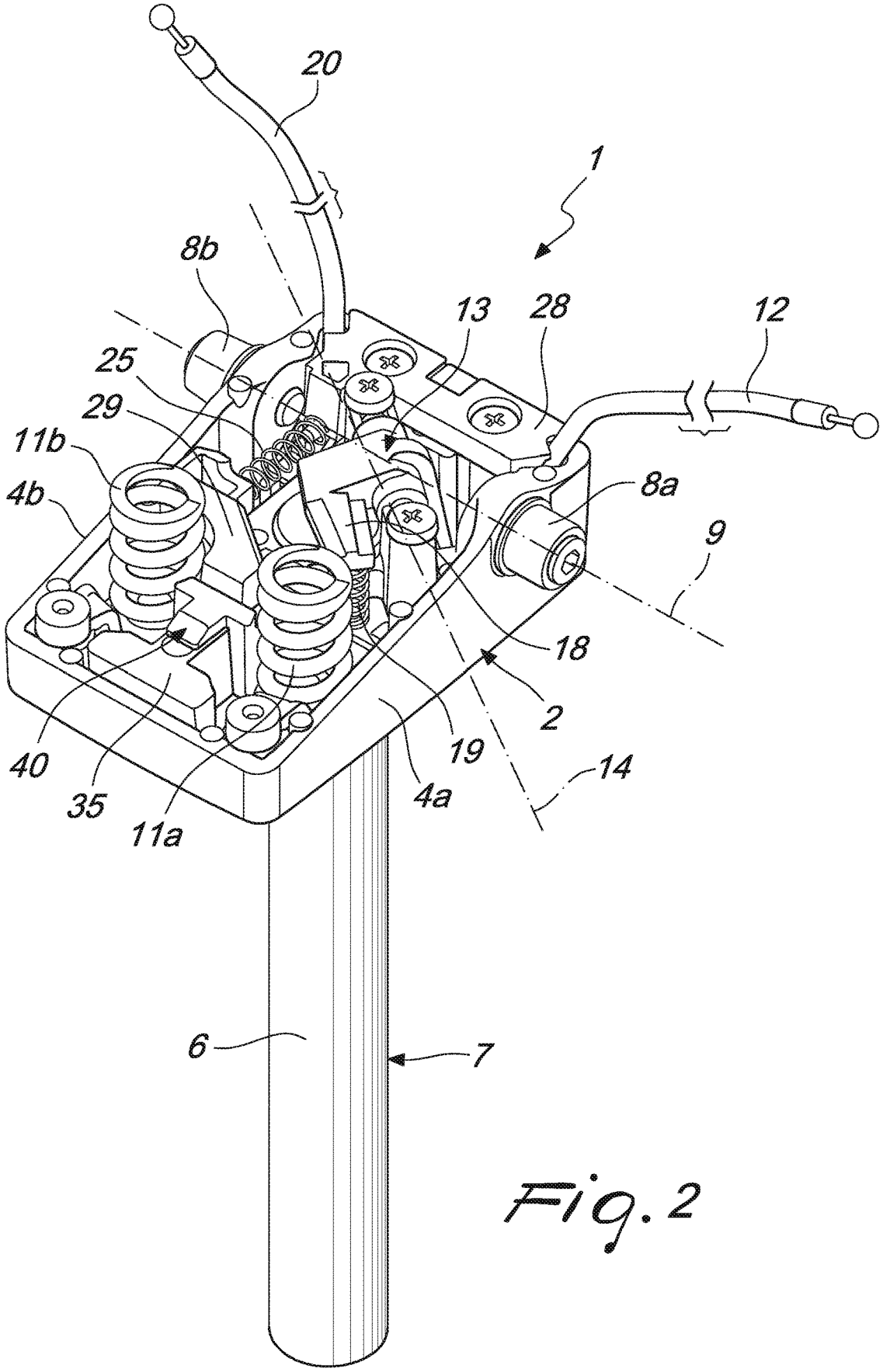
FIG. 2 shows the device, without the plate associated with a backrest.
Figure 3:
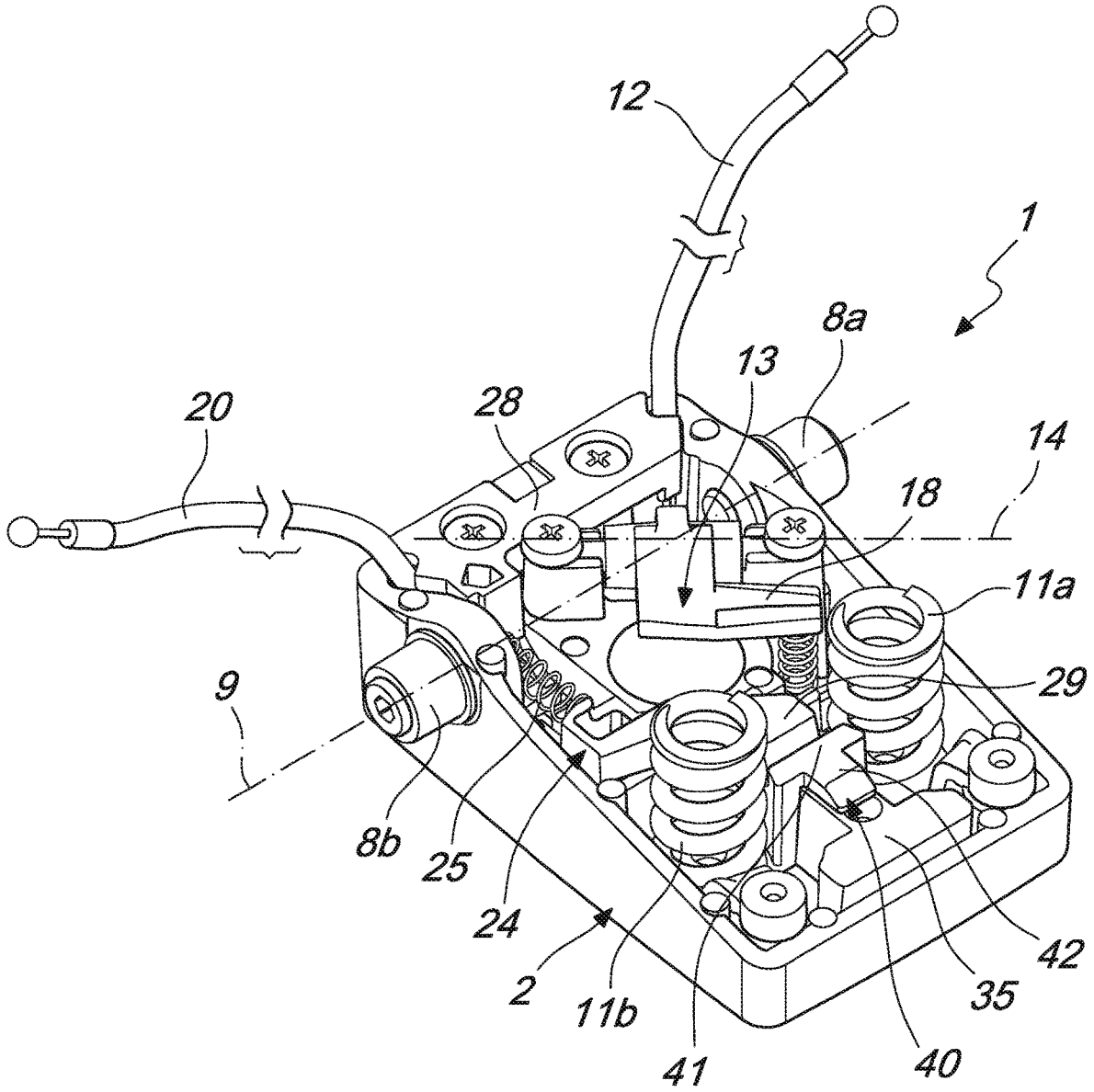
FIG. 3 is a different view of the device of the previous figure.
Figure 4:
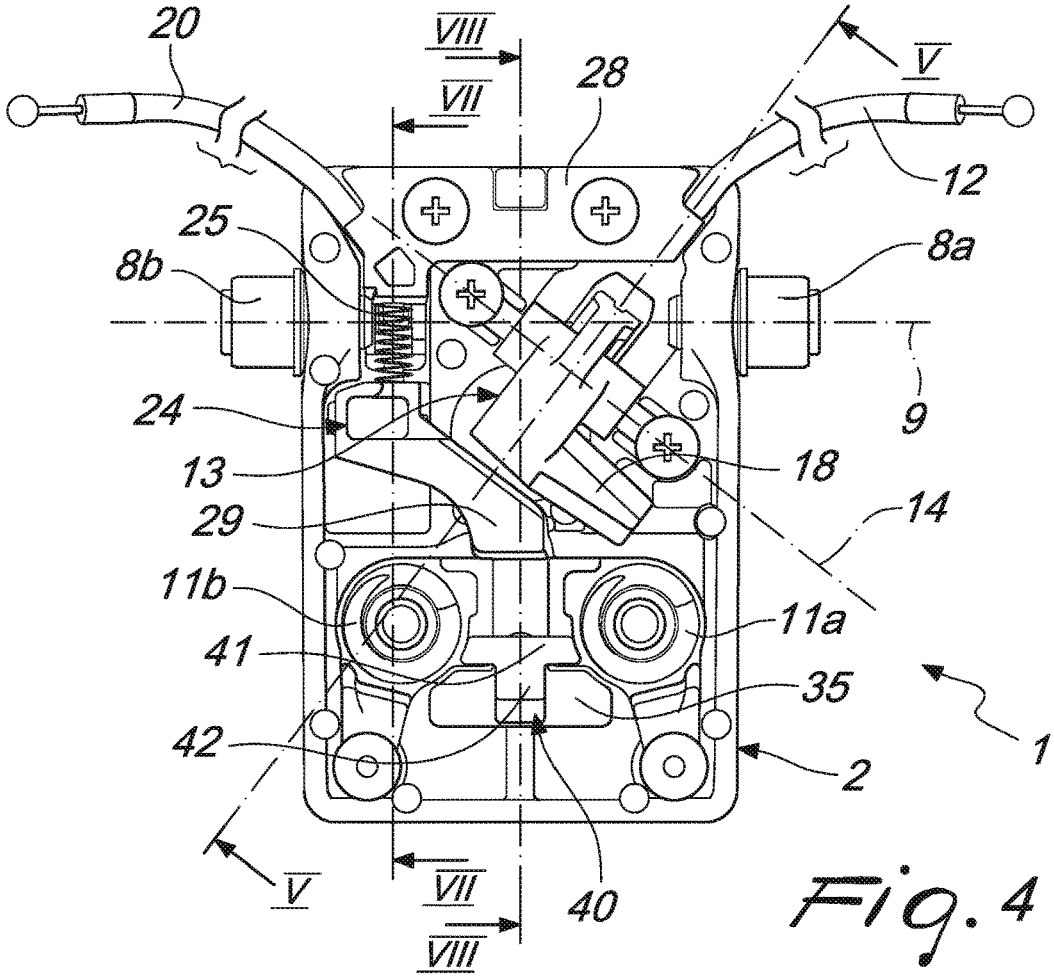
FIG. 4 is a view from above of the device of the previous figure in the free-rocking condition.
Figure 5:
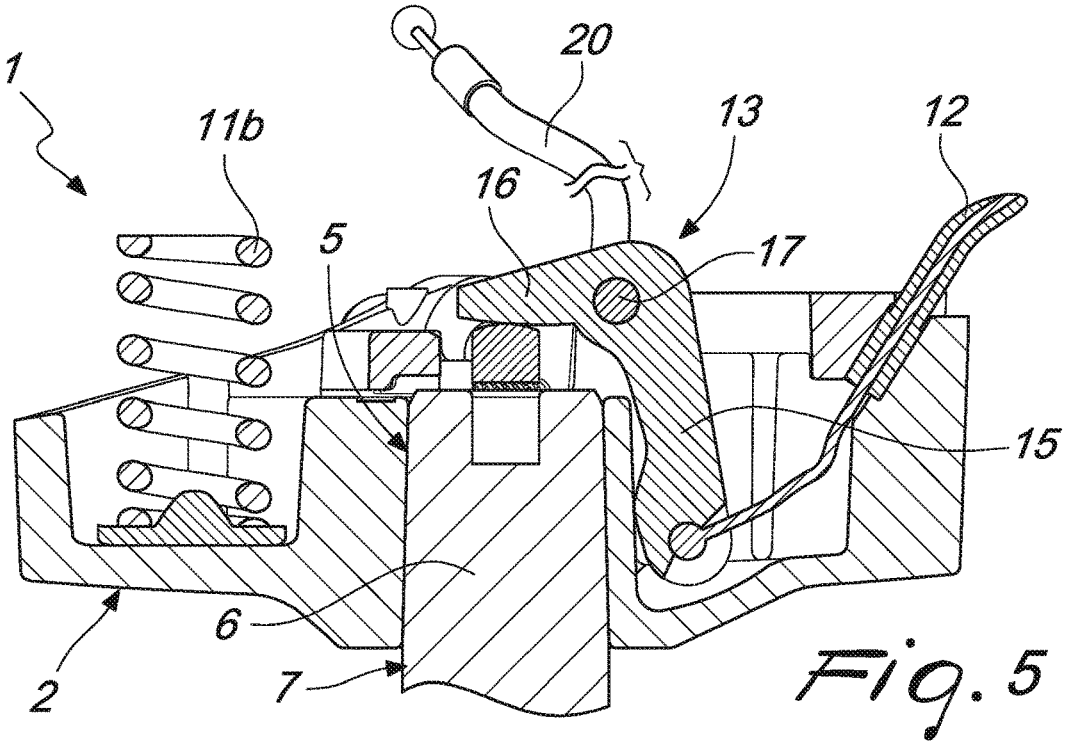
FIG. 5 is a cross-sectional view of the device taken along the line V-V of FIG. 4.
Figure 6:
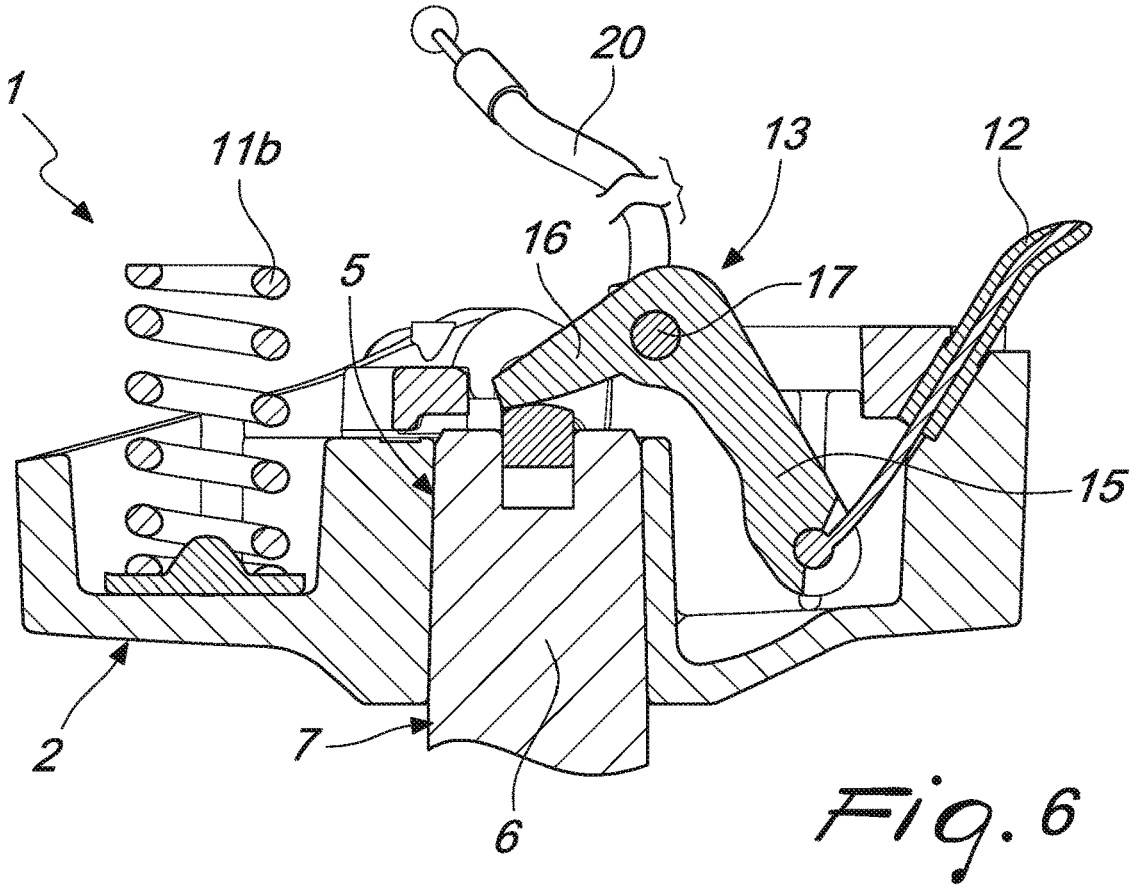
FIG. 6 shows the device of the previous figure in the condition of activation of the central gas-operated post.
Figure 7:
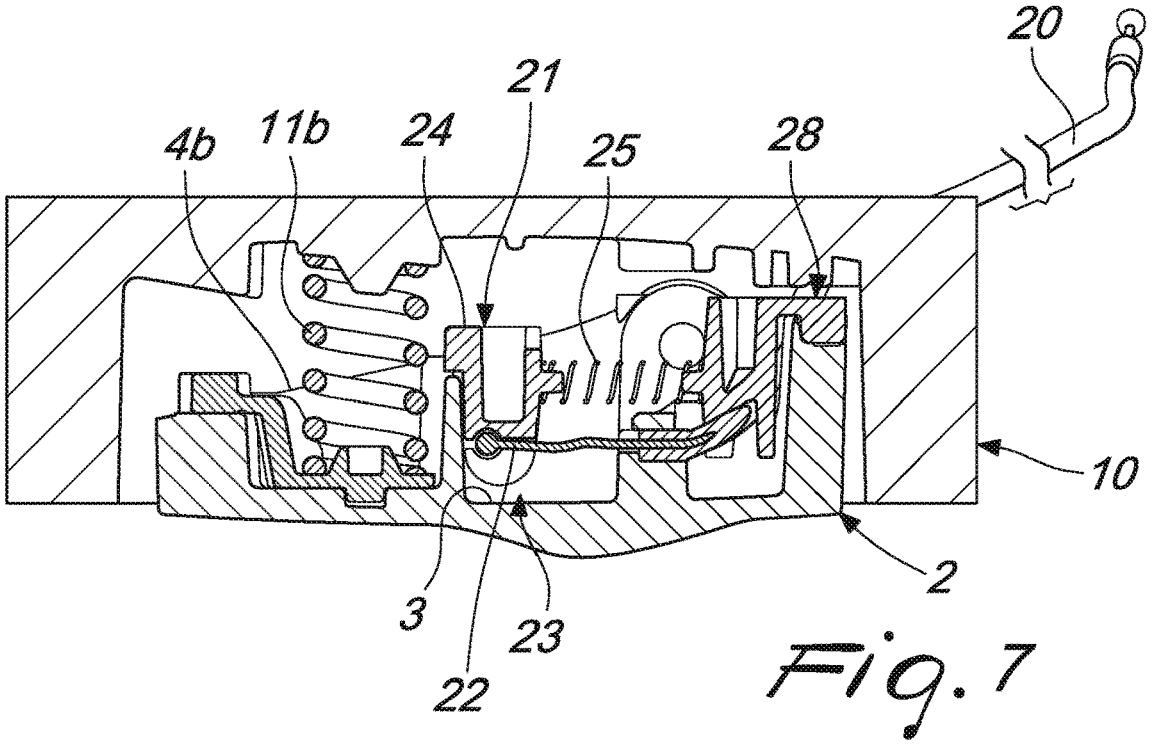
FIG. 7 is a cross-sectional view of the device taken along the line VII-VII of FIG. 4.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to the figures, the reference numeral 1 generally designates an adjustment device for a chair (not shown) which comprises a rocking mechanism composed of a first plate 2, which has a substantially C-shaped box-like shape so as to define a flat first base 3 and two first side wings 4*a*, 4*b*; at the first base 3 there is a protruding bushing 5 at which the end of a stem 6 of a central gas-operated post 7, mounted on a footing and used for the height adjustment of a seat (not shown), is associated.

A second plate 10, which is fixed to a seat (not shown) or can be constituted also by a component integral with the seat, is articulated to the first plate 2 so that it can rock, by virtue of first pivots 8*a*, 8*b* which lie on a first axis 9 which is transverse and eccentric with respect to the first plate 2.

The first plate 2 interacts with means adapted to contrast the rocking of the backrest, such means being constituted by a pair of first springs 11*a*, 11*b* which protrude from the first base 3 and are interposed between the latter and the second plate 10.

At one side of the first plate 2, directed toward the front part of the seat, a first cable 12 is slideably associated and is adapted to activate a lever 13, which is articulated internally to the first plate 2 at a second axis 14, different from the first axis 9, and arranged at an angle to the longitudinal axis of the first plate 2.

The lever 13 is L-shaped so as to define a first wing 15, which is directed toward the first base 3, and a second wing 16, which is adjacent to and lies above the central gas-operated post 7, and such lever is pivoted, in the connecting region between the first wing and the second wing 15, 16, to a second pivot 17 arranged at the second axis 14.

One end of the first cable 12 is connected to the free end of the first wing 15 so that a traction imposed on the first cable 12 is followed by a rotation of the lever 13 so as to make the terminal end of the second wing 16 interact with the central gas-operated post 7, so as to activate the height adjustment of the seat.

Advantageously a tab 18 protrudes radially to the second wing 16 and interacts with a second spring 19 which is interposed between the tab 18 and the underlying first base 3 of the first plate 2.

Such second spring 19 allows the return to a neutral position of the lever 13 once the first cable 12 has been released so as to not activate the central gas-operated post 7.

A second cable 20 is further slideably associated with a side of the front part of the first plate 2 which lies opposite the side for inserting the first cable 12, the second cable being adapted to activate a mechanism 21 which allows or prevents the rocking of the second plate 10.

Such second cable 20 is guided inside the first plate 2 so that its terminal end 22 arranges itself proximate to the bottom of a first cavity 23 which is provided inside and longitudinally to the first plate 2, on a side thereof which lies opposite the entry side of the first cable 12.

Such mechanism 21 is constituted by a slider that has a substantially S-shaped plan configuration so as to define a first arm 24 which is shaped like a parallelepiped and is accommodated inside the first cavity 23 with the possibility to slide axially with respect to the first cavity 23 in contrast with a third spring 25 which is interposed between the vertical rear wall 26 of the first arm and a facing wall 27 of a block 28 which is associated internally with the first plate 2 in front of the first cavity 23.

A bridge 29 is connected to the upper end of the first arm 24 and is arranged along an axis that is inclined with respect to the longitudinal axis of the first plate 2; a second arm 30 is connected in a lower region to the terminal end of the bridge 29, which lies substantially at the longitudinal central axis of the first plate 2, the second arm being parallelepiped-shaped, having a substantially T-shaped plan configuration, and being accommodated inside a second cavity 31 which is provided in the rear region of the first plate 2 where the first springs 11*a*, 11*b* also are arranged.

The second arm 30, which slides freely and axially with respect to the second cavity 31 along an axis that is longitudinal to the first plate 2, has a first shank 32, with a rectangular plan shape, which is arranged in the interspace between the first springs 11*a*, 11*b*, and the upper surface 33 of which is arranged on a plane that lies lower than the plane of arrangement of the bridge 29.

The axial movement of the second arm 30 is guided, since that arm lies between a pair of shoulders 34*a* and 34*b*, which are mutually parallel and protrude at right angles to the second cavity 31; the longitudinal extension of each one of the pair of shoulders 34*a* and 34*b* is substantially equal to the length of the shank 32.

A first head 35 is connected to the first shank 32 and has a rectangular plan shape with dimensions such that its third wings 36*a*, 36*b* protrude laterally beyond the space occupation of the pair of shoulders 34*a* and 34*b*: this determines the point of maximum retraction of the first head 35, and therefore of the mechanism 21, within the second cavity 31.

In this condition an empty space 37 is defined, between the terminal end of the first head 35 and the bottom wall 38 of the second cavity 31, which constitutes a temporary seat for a tooth 39 which protrudes internally and downward with respect to the second plate 10.

Figure 8:
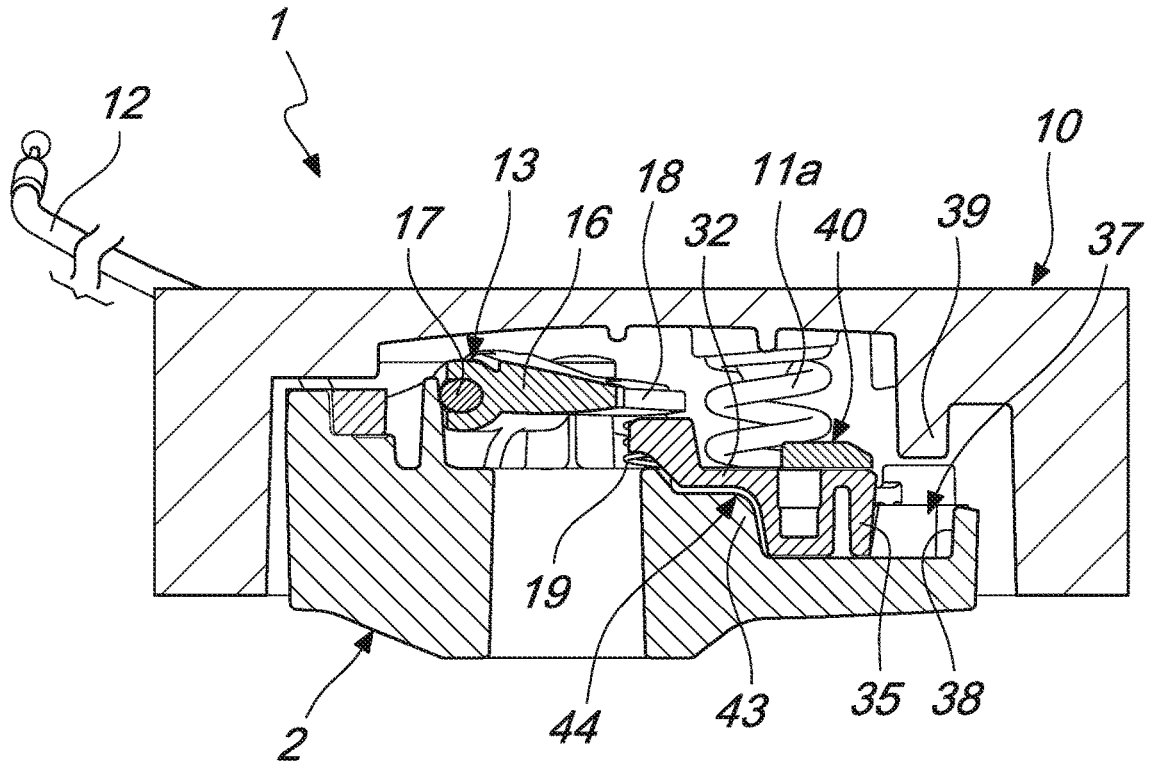
FIG. 8 is a cross-sectional view of the device taken along the line VIII-VIII of FIG. 4.
Figure 9:
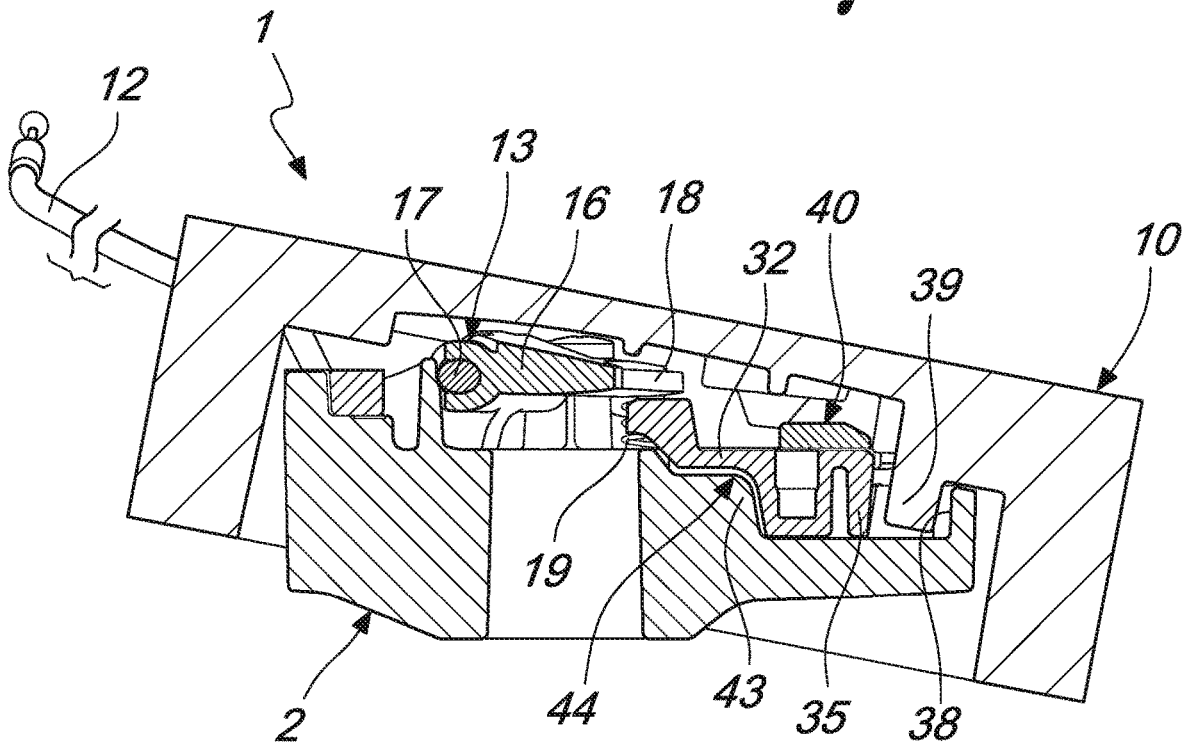
FIG. 9 shows the device of the previous figure in the free-rocking condition.
Figure 10:
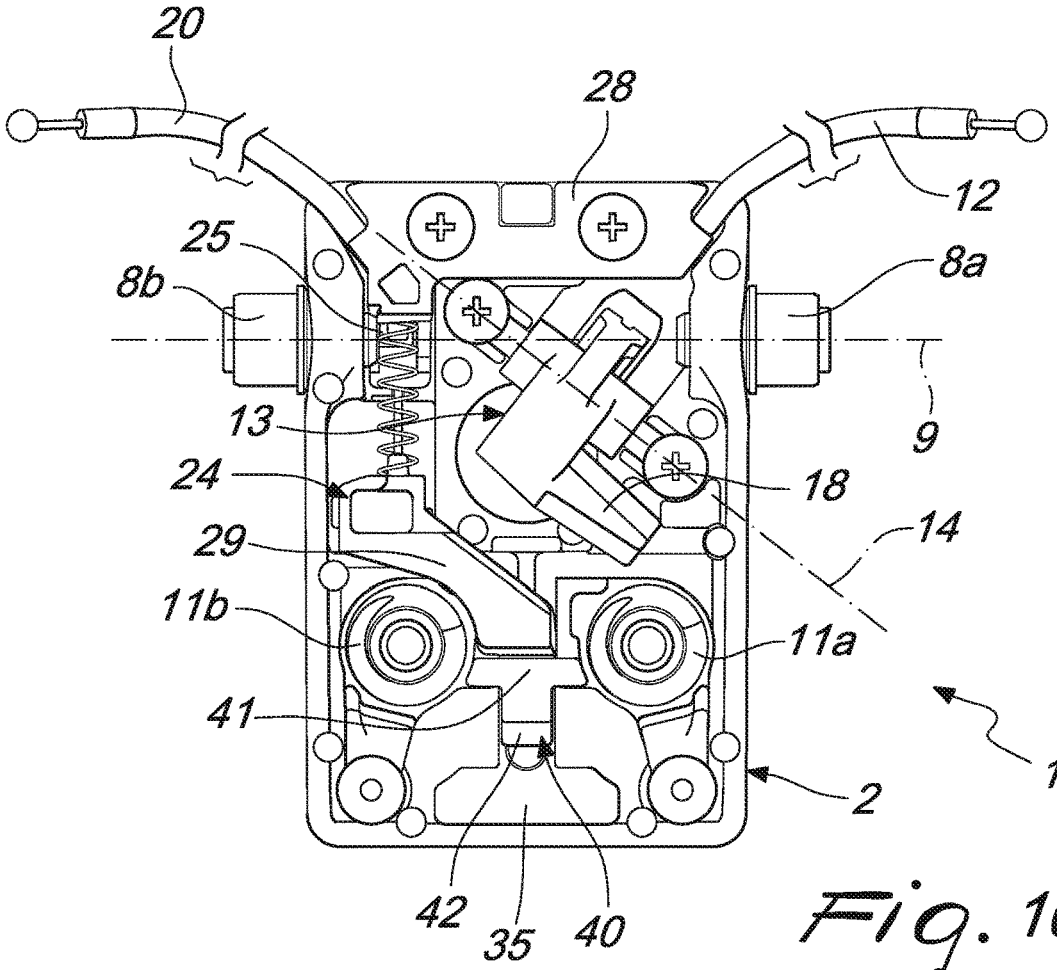
FIG. 10 shows the device of FIG. 4 in the rocking-prevented condition.
Figure 11:
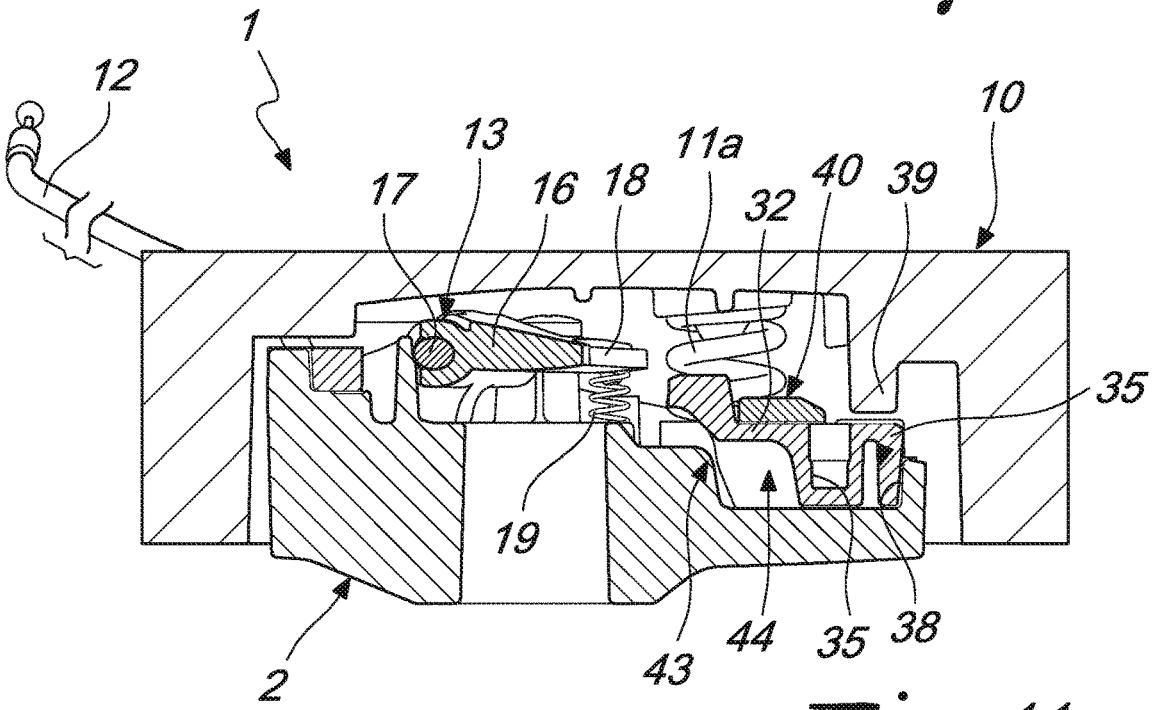
FIG. 11 shows the device of FIG. 8 in the rocking-prevented condition.
Figure 12:
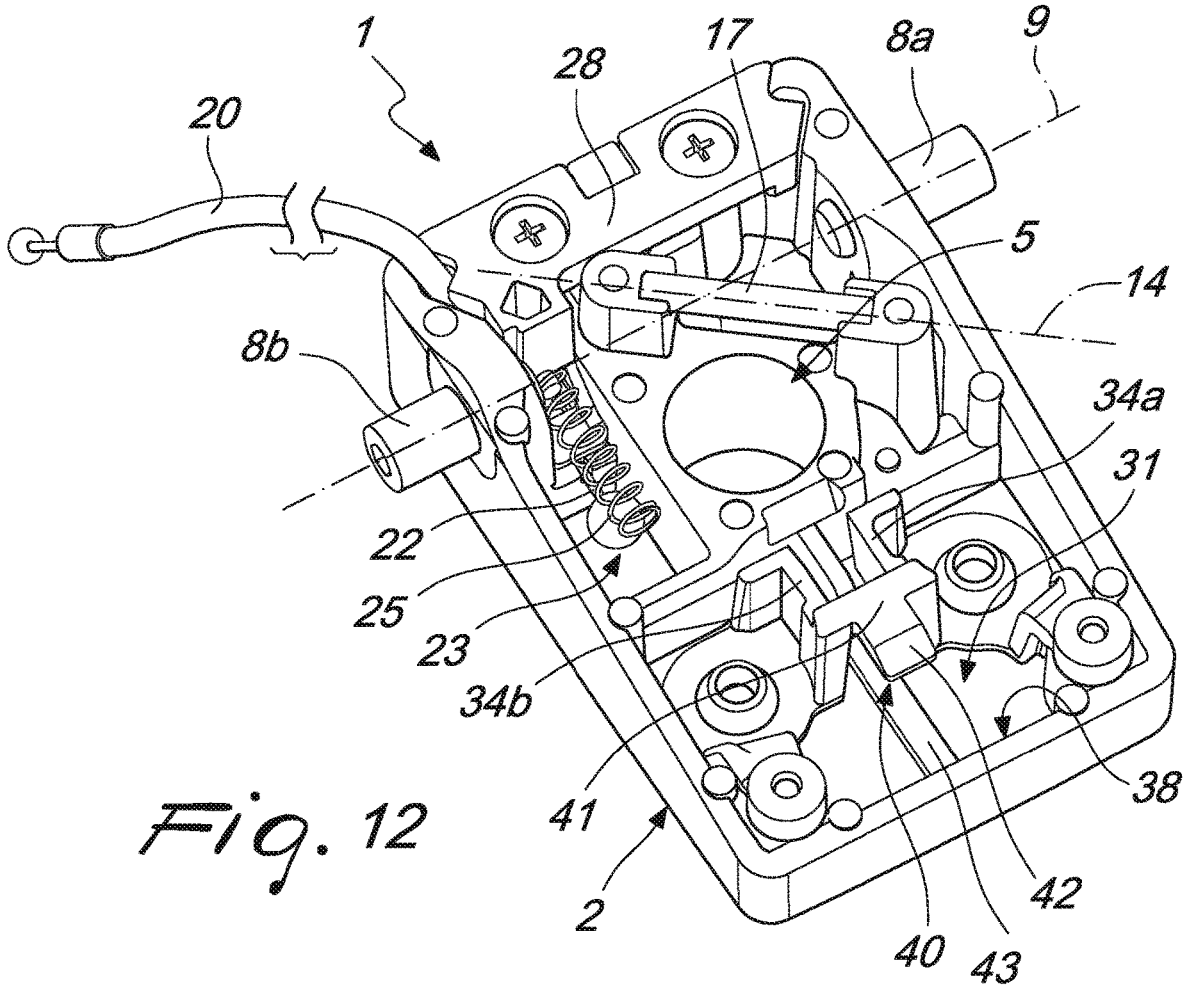
FIG. 12 shows the first plate with some components inserted.
Figure 13:
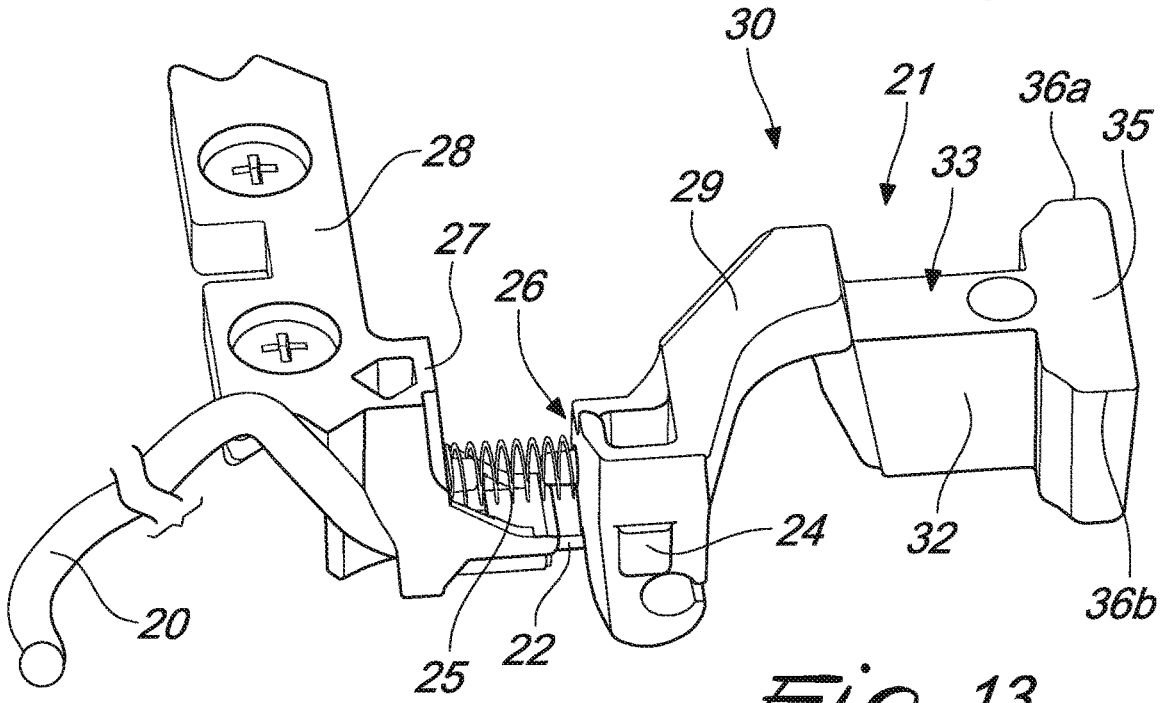
FIG. 13 is a perspective view of the mechanism that allows or prevents the rocking of the second plate.

This condition corresponds to the possibility for the second plate 10 to rock with respect to the first plate 2, as shown in FIGS. 8 and 9.

The first shank 32 and the first head 35 advantageously interact with adapted guides, such as a T-shaped bar 40, the second head 41 of which is arranged transversely so as to connect the upper terminal ends of the pair of shoulders 34*a* and 34*b* which are directed away with respect to the bridge 29.

The second head 41 lies above the underlying upper surface 33 of the first shank 32.

The bar 40 has a second shank 42 which arranges itself along the longitudinal axis of the first plate 2 in the direction of the bottom wall 38 and surmounts, in the free-rocking condition for the second plate 10, the entire thickness of the first head 35.

An additional guide for the sliding of the first shank 32 and the first head 35 is provided by the presence of a longitudinal ridge 43 which protrudes from the bottom of the second cavity 31 and is accommodated inside a complementarily-shaped seat 44 which is provided below the first shank 32 and optionally also below the first head 35.

The third spring 25 pushes the mechanism 21, bringing the second head 35 adjacent to the bottom wall 38 of the second cavity 31, thus preventing the rocking of the second plate 10.

The activation of the second cable 20 causes the retraction of the mechanism 21 until the second head 35 is brought into abutment against the end of the pair of shoulders 34*a* and 34*b*, thus freeing up the empty space 37 in order to temporarily accommodate the tooth 39 thereat.

Thus it has been found that the invention fully achieves the intended aim and objects, an adjustment device for a chair that has a rocking mechanism having been obtained that makes it possible to achieve at the same time, rapidly, simply and optimally, both the activation and prevention of rocking for a chair, and also the activation of the raising of that chair.

Furthermore the device is structurally simple and free from sticking.

Naturally the materials used as well as the dimensions of the individual components of the device according to the invention may be more relevant according to specific requirements.

The characteristics indicated above as advantageous, convenient or the like, may also be missing or be substituted by equivalent characteristics.

The disclosures in Italian Patent Application No. 102017000057341 from which this application claims priority are incorporated herein by reference.

The invention claimed is:

1. An adjustment device for a chair, said adjustment device comprising:

a rocking mechanism composed of a first plate, which is fixed to a central gas-operated post for the height adjustment of a seat;

a second plate that is articulated to said first plate, about a first axis that is transverse to said first plate and so that said second plate can rock, said second plate being fixed to a seat or being integral with a seat;

means that interact with said second plate and that are adapted to contrast the rocking of a backrest;

a first cable that is slideably associated with said first plate;

a lever that is adapted to be activated by said first cable and that is articulated internally to said first plate at a second axis, wherein the second axis is different from said first axis, and that is adapted to activate the height adjustment of said seat;

a second cable being further slideably associated with said first plate; and a mechanism that is adapted to be activated by said second cable and that allows or prevents the rocking of said second plate.

2. An adjustment device for a chair, said adjustment device comprising:

a rocking mechanism composed of a first plate, which is fixed to a central gas-operated post for the height adjustment of a seat;

a second plate that is articulated to said first plate, about a first axis that is transverse to said first plate and so that said second plate can rock, said second plate being fixed to a seat or being integral with a seat;

means that interact with said second plate and that are adapted to contrast the rocking of a backrest;

a first cable that is slideably associated with said first plate;

a lever that is adapted to be activated by said first cable and that is articulated internally to said first plate at a second axis, wherein the second axis is different from said first axis, and that is adapted to activate the height adjustment of said seat;

a second cable being further slideably associated with said first plate; and a mechanism that is adapted to be activated by said second cable and that allows or prevents the rocking of said second plate, wherein said second plate is articulated to said first plate so that said second plate can rock, by virtue of first pivots which lie on said first axis which is transverse and eccentric with respect to said first plate, said first plate interacting with a pair of first springs, said first cable being slideably associated with a side of a front part of said first plate and being adapted to activate said lever, which is articulated inside said first plate at a second axis which is distinct from said first axis and is inclined with respect to the longitudinal axis of said first plate, said lever being L-shaped so as to define a first wing, which is directed toward a first base of said first plate, and a second wing, which is adjacent to and lies above said central gas-operated post, said lever being pivoted, in a connecting region between said first wing and said second wing, to a second pivot arranged at said second axis.

3. The device according to claim 2, wherein one end of said first cable is connected to a free end of said first wing so that a traction imposed on said first cable is followed by a rotation of said lever so as to make a terminal end of said second wing interact with said central gas-operated post, so as to activate the height adjustment of said seat, the device further comprising a tab protruding radially to said second wing and interacting with a second spring, of said pair of first springs, which is interposed between said tab and said, underlying, first base of said first plate, said second spring allowing a return to a neutral position of said lever once said first cable has been released so as to not activate said central gas-operated post.

4. An adjustment device for a chair, said adjustment device comprising:

a rocking mechanism composed of a first plate which is fixed to a central gas-operated post for the height adjustment of a seat;

a second plate that is articulated to said first plate, about a first axis that is transverse to said first plate and so that said second plate can rock, said second plate being fixed to a seat or being integral with a seat;

means that interact with said second plate and that are adapted to contrast the rocking of a backrest;

a first cable that is slideably associated with said first plate;

a lever that is adapted to be activated by said first cable and that is articulated internally to said first plate at a second axis, wherein the second axis is different from said first axis, and that is adapted to activate the height adjustment of said seat;

a second cable being further slideably associated with said first plate; and a mechanism that is adapted to be activated by said second cable and that allows or prevents the rocking of said second plate, wherein said second cable is slideably associated with a side of a front part of said first plate which lies opposite an entry side for inserting said first cable, said second cable being adapted to activate said mechanism which allows or prevents a rocking of said second plate, said second cable being guided inside said first plate so that a terminal end thereof arranges itself proximate to a bottom of a first cavity which is provided inside and longitudinally to said first plate, on a side thereof which lies opposite the entry side of said first cable.

5. The device according to claim 4, wherein said mechanism is constituted by a slider that has a substantially S-shaped plan configuration so as to define a first arm which is shaped like a parallelepiped and is accommodated inside said first cavity with the possibility to slide axially with respect to said first cavity in contrast with a third spring which is interposed between a vertical rear wall of said first arm and a facing wall of a block which is associated internally with said first plate in front of said first cavity, a bridge being connected to an upper end of said first arm and being arranged along an axis that is inclined with respect to a longitudinal central axis of said first plate.

6. The device according to claim 5, wherein a second arm is connected in a lower region to a terminal end of said bridge, which lies substantially at the longitudinal central axis of said first plate, said second arm being parallelepiped-shaped, having a substantially T-shaped plan configuration, and being accommodated inside a second cavity which is provided in a rear region of said first plate where said first springs also are arranged, said second arm, which slides freely and axially with respect to said second cavity along an axis that is longitudinal to said first plate, having a first shank, with a rectangular plan shape, which is arranged in an interspace between said first springs, and a lower surface of which is arranged on a plane that lies lower than plane of arrangement of said bridge, an axial movement of said second arm being guided, since said arm lies between a pair of shoulders which are mutually parallel and protrude at right angles to said second cavity, and a longitudinal extension of each shoulder of said pair of shoulders being substantially equal to a length of said shank.

7. The device according to claim 6, wherein a first head is connected to said first shank and has a rectangular plan shape with dimensions such that third wings thereof protrude laterally beyond the space occupation of said pair of shoulders so as to determine a point of maximum retraction of said first head, and therefore of said mechanism, within said second cavity, in this condition an empty space being defined, between a terminal end of said first head and a bottom wall of said second cavity, which constitutes a temporary seat for a tooth which protrudes internally and downward with respect to said second plate and allows said second plate to rock with respect to said first plate.

8. The device according to claim 7, wherein said first shank and said first head interact with adapted guides, of a T-shaped bar a second head of which is arranged transversely so as to connect upper terminal ends of said pair of shoulders which are directed opposite with respect to said bridge, said second head lying above said, underlying, upper surface of said first shank, said bar having a second shank which arranges itself along the longitudinal axis of said first plate in a direction of said bottom wall and surmounts, in a free-rocking condition for said second plate, an entire thickness of said first head.

9. The device according to claim 7, wherein an additional guide for the sliding of said first shank and said first head is provided by the presence of a longitudinal ridge which protrudes from a bottom of said second cavity and is accommodated inside a complementarily-shaped seat which is provided below said first shank and optionally also below said first head, said third spring pushing said mechanism, bringing said second head adjacent to said bottom wall of said second cavity, thus preventing the rocking of said second plate.

10. The device according to claim 7, wherein the activation of said second cable causes a retraction of said mechanism until said second head is brought into abutment against the end of said pair of shoulders, thus freeing up an empty space in order to temporarily accommodate said tooth thereat.

* * * * *